United States Patent [19]

Hermann

[11] Patent Number: 4,623,080

[45] Date of Patent: Nov. 18, 1986

[54] TROUSER HANGER

[76] Inventor: Hermann Roloff, Zentralstrasse 139, 5430 Wettingen, Switzerland

[21] Appl. No.: 682,074

[22] Filed: Dec. 17, 1984

[30] Foreign Application Priority Data

Dec. 27, 1983 [CH] Switzerland ..... 6925/83

[51] Int. Cl.[4] ..... A47G 25/48

[52] U.S. Cl. ..... 223/95

[58] Field of Search ..... 223/95, 96, 85, DIG. 2

[56] References Cited

U.S. PATENT DOCUMENTS

| | | | |
|---|---|---|---|
| 697,103 | 4/1902 | Pickhardt | 223/95 |
| 2,526,203 | 10/1950 | Diebold | 223/96 |
| 2,594,602 | 4/1952 | Walter | 223/95 |
| 2,712,891 | 7/1955 | Mantell | 223/95 |
| 2,829,811 | 4/1958 | Baschnonga | 223/95 |

FOREIGN PATENT DOCUMENTS

| | | | |
|---|---|---|---|
| 234567 | 7/1961 | Australia | 223/95 |
| 280983 | 12/1914 | Fed. Rep. of Germany | 223/95 |
| 2515151 | 10/1975 | Fed. Rep. of Germany . | |

*Primary Examiner*—Louis K. Rimrodt
*Assistant Examiner*—Joseph S. Machuga
*Attorney, Agent, or Firm*—Werner W. Kleeman

[57] ABSTRACT

The slip-proof trouser hanger faultlessly stretches trousers hung thereupon. The legs of the trousers cannot slide off from stretching prongs of the trouser hanger and the material of the trousers is not undesirably deformed or distorted by the trouser hanger. Differences in the width of the trousers' legs are permitted and compensated for by one movable pair of stretching prongs at a stretching rod of the trouser hanger. It is of significance in the design of the trouser hanger that engaging edges for engaging the legs of the trousers in the movable pair of stretching prongs are rearwardly offset with respect to a pivot axis of such movable pair of stretching prongs, i.e. in a direction towards the other pair of stretching prongs, by an amount in the range of about 3 to about 4 mm.

15 Claims, 15 Drawing Figures

Fig. 1
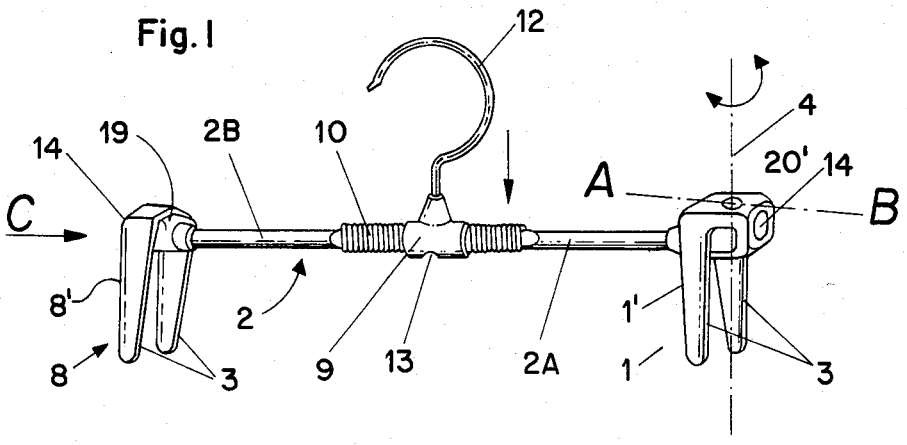
Fig. 2
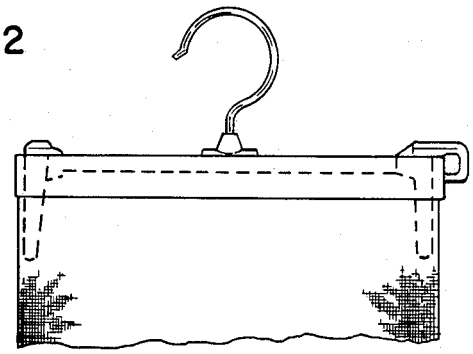
Fig. 3A
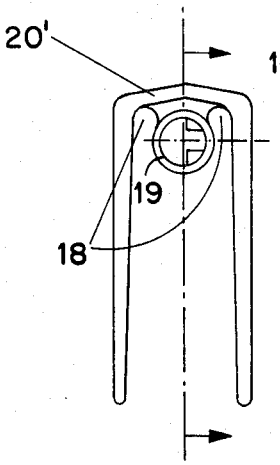
Fig. 3B
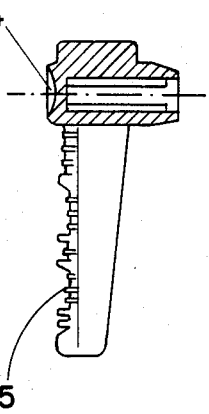
Fig. 4A
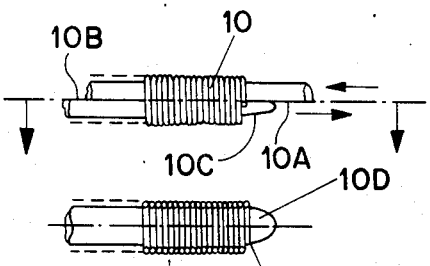
Fig. 4B

TROUSER HANGER

BACKGROUND OF THE INVENTION

The present invention relates to a new and improved construction of a trouser hanger stretchingly holding trousers at the legs thereof In conventional trouser hangers, the trousers are suspended at their legs by means of two holders or retainers. This is achieved in such a manner that the holders project by several centimeters into the legs, namely precisely in the region of the creases. The trousers are thus stretched or tightened while being suspended from the trouser hanger and the creases therein are better preserved. It is known when using conventional trouser hangers that it happens relatively frequently that the one or the other leg of the trousers slides off from its holder although the correct stretching length of the trouser hanger has been selected, i.e. a trouser hanger stretching length which corresponds to the width of the legs of the trousers. Such undesired trouser leg slide-off even occurs when trouser hangers are used which contain holders with toothed or serrated trouser engaging edges and in which the holders are made of slide-proof plastics.

The cause thereof is predicated upon the usually relatively wide manufacturing tolerances observed in the clothing industry as compared, for example, with products manufactured in the machine industry. With respect to the legs of trousers, the width of such legs have different manufacturing dimensions, e.g. one leg may be wider than the other, for instance, differences of about one centimeter have been found. In conventional trouser hangers the narrower or less wide leg of the trousers determines the limits or effective length of the trouser hanger and, thus, there results a certain slackness.

Depending on the amount of play or clearance between the holder and the leg as well as on the type of trouser material which may be stretchable to a greater or lesser extent and which material may be smooth or rough, and furthermore depending on the slide resistance of the holder surface or the shape of the trouser engaging edges of the holders, one leg of the trousers may slide off from the trouser hanger in the most unfavorable case. When such trouser leg slide-off occurs more frequently, trouser hangers of greater length inevitably will be selected. While a more slide-proof tensioning or tightening is thereby obtained, such is extremely detrimental to the legs of the trousers due to the strong spring force of the longer trouser hanger. Specifically, the legs of the trousers are thus excessively stretched to an extent resulting in permanent deformation or distortion of the trouser legs in the region which is engaged and tensioned or strectched by the holders, especially when wet trouser legs are suspended from the trouser hanger. When using trouser hangers with a too high spring force and when, additionally, the entire spring force at each end of the trouser hanger acts only upon one single prong of the holder, the prongs occasionally may break off, particularly when the prongs are made of brittle and easily fracturable plastics. A number of problems are solved by the invention which is described hereinbelow.

There have also been proposed solutions to the aforementioned problems which, however, cannot work because in the construction of such trouser hangers an important law of mechanical statics has not been observed with respect to the action of the tensioning or stretching force. This law is the law of stable equilibrium. All the proposed solutions, however, are based on an unstable equilibrium, such as the solution which has been suggested, for example, in German Patent Publication No. 2,515,151. It is stated in claim 1 of this publication: " . . . rotational axes (7, 7'), about which the bifurcated holding means (8, 8') are pivotable." Should a pivoting adjustment be intended thereby for the purpose of compensating for differences in the widths of the trouser legs, which is not evident from the description in the aforementioned German patent publication, the drawing, however, unambiguously shows that the trouser engaging edges of the bifurcated holding means are positioned outside or in front of the rotational axes, whereby an unstable equilibrium condition arises.

SUMMARY OF THE INVENTION

Therefore, with the foregoing in mind, it is a primary object of the present invention to provide a new and improved construction of a trouser hanger stretchingly holding trousers at the legs thereof and which is not afflicted with the drawbacks and limitations of the prior art constructions heretofore discussed.

Another and more specific object of the present invention is directed to the provision of a new and improved construction of a trouser hanger stretchingly holding trousers at the legs thereof and which provides a practically slide-proof hanging of the trousers thereat.

Now in order to implement these and still further objects of the invention, which will become more readily apparent as the description proceeds, the trouser hanger of the present development is manifested by the features that a first holder or retainer movable about an axis and a second rigid holder or retainer are provided at a stretching rod.

According to the invention, protection against undesired trouser slide-off is achieved due to the fact that the holder or retainer is mounted at one of the two ends of the stretching rod in a movable manner and not in the conventional fixed and rigid manner. Now the movable holder or retainer can faultlessly adapt to greater differences in the widths of the trouser legs to the extent of, for instance, several millimeters by yielding to the one or the other side or direction. Consequently, the tensioning or stretching force of the trouser hanger is exactly halved and the same degree of tensioning or stretching is effected by each stretching prong of the holders or retainers and thus at each of the trouser legs.

In order to faultlessly insure the trouser tensioning or stretching function, particular attention has been paid in the design of the inventive trouser hanger that the action of the tensioning or stretching force is effective in a stable manner, i.e. does not act in an indiscriminate or even unstable manner. An unstable equilibrium condition not only would cause the opposite effect but would even significantly increase the trouser slide-off risk. The stable equilibrium condition has been importantly obtained due to the fact that the engaging edges of the pair of stretching prongs of the movable holder or retainer are arranged rearwardly offset by an amount in the range of about 3 to about 4 millimeters with respect to the pivot or rotational axis of such movable holder.

A further important aspect in the construction of the inventive trouser hanger is the provision of an intermediate space between the two prongs of each pair of stretching prongs. Trouser hangers containing a movable pair of stretching prongs at which the trouser legs are individually tensioned or stretched and with the trouser legs held in parallel spaced relationship such that air may enter between the trouser legs, are particularly useful in those instances where the trousers have become wet. It is well known that during wear of trousers, particularly during adverse climatic conditions, the trouser legs become wettest at their extreme ends. In this respect, the inventive trouser hanger contrasts, for example, with trouser hangers at which the two trouser legs are simply contactingly placed upon each other and clamped together in this state. An intermediate space of about 2 cm has been found to be the most favorable intermediate space. The selection of a greater distance would not be appropriate since thereby the space requirements in wardrobes and display stands would be increased.

In particular there is also provided a clearance between head members of the holders or retainers and the individual prongs of the associated pairs of prongs. Such clearance enables the trouser legs to be snugly mounted with respect to the stretching rod of the trouser hanger.

The trouser manufacturing industry should not be the least to be especially interested in distributing and propagating the inventive trouser hanger because this trouser hanger, due to its movable holder or retainer or movable pair of stretching prongs provided thereat, affords greater manufacturing tolerances with respect to the trouser leg width. It is known that such greater manufacturing tolerances have a cost-reducing effect for the trouser production.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 1 is a perspective view of an exemplary embodiment of the trouser hanger according to the invention;

FIG. 2 is a view of the trouser hanger illustrated in FIG. 1 and in the operative state in which trousers are mounted thereupon at their trouser legs;

FIGS. 3A and 3B respectively show a front view looking in the direction of the arrow "C" in FIG. 1 and a partially sectional view of the rigidly arranged pair of stretching prongs of the trouser hanger shown in FIG. 1;

FIGS. 4A and 4B respectively show a side view and a top plan view looking in the direction of the arrow "D" in FIG. 1 of the interior ends of the stretching rod members and the anchoring of the tension spring of the trouser hanger illustrated in FIG. 1;

DETAILED DESCRIPTION OF THE PREFERRED EMBODIMENTS

Describing now the drawings, it is to be understood that only enough of the construction of the trouser hanger has been shown in detail as is needed to enable one skilled in the art to readily understand the underlying principles and concepts of the present invention, while simplifying the showing of the drawings. Turning attention now specifically to FIG. 1, there has been illustrated in a perspective view the entirety of an exemplary embodiment of the inventive trouser hanger. According to the invention, slide-off of the trouser legs is prevented by the inventive trouser hanger due to the fact that one of the two holders or retainers 1 and 8, namely the holder or retainer 1, or one of the pairs of stretching prongs 1' and 8' at the stretching rod 2, namely here the pair of stretching prongs 1', is movable. Differences which may be present between the widths of the trouser legs thus can be compensated for and the tensioning or stretching force can be uniformly distributed over both of the trouser legs.

Figure 5B:
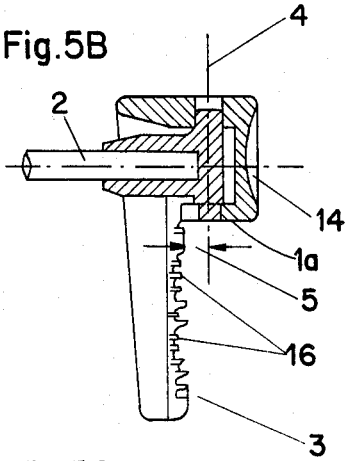

The trouser leg engagement edges 3 of the movable pair of stretching prongs 1' are located rearwardly offset by an amount in the range of about 3 to about 4 millimeters with respect to the pivot or rotational axis 4 of the movable holder or retainer 1, as illustrated in FIG. 5B by the dimension indicating arrows and designated by reference numeral 5.

Figure 5A:
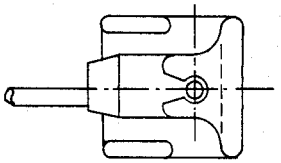
FIGS. 5A, 5B and 5C respectively show, from the top to the bottom, a bottom view, a partially sectional view along the line A–B in FIG. 1, and a top plan view of the movable pair of stretching prongs of the trouser hanger illustrated in FIG. 1.
Figure 6A:
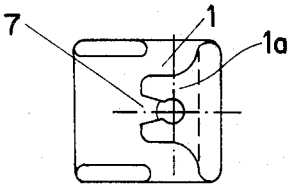
FIGS. 6A, 6B and 6C respectively show, from the top to the bottom, a bottom view, a partially sectional view along the line A–B in FIG. 1, and a top plan view of the movable pair of stretching prongs illustrated in FIG. 5, but in the absence of the articulated bearing head member thereof.
Figure 7A:
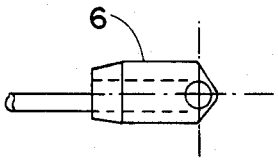
FIGS. 7A, 7B and 7C respectively show, from the top to the bottom, a bottom view, a partially sectional view along the line A–B in FIG. 1, and a top plan view of the articulated bearing head member of the movable pair of stretching prongs illustrated in FIG. 5.
Figure 6B:
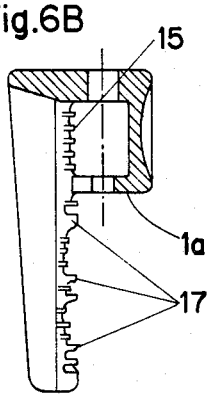
Figure 7B:
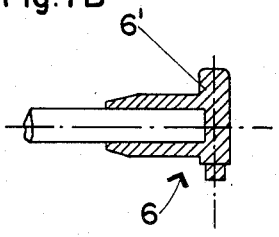
Figure 5C:
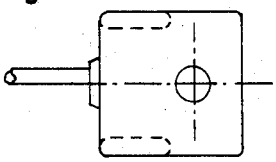
Figure 6C:
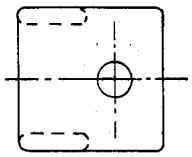
Figure 7C:
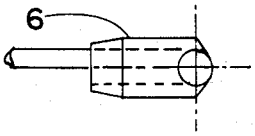

The movable pair of stretching prongs 1' is constructed in such a manner that it can be pressed onto an articulated bearing head member 6, see FIG. 7B, during assembly by slightly tilting this pair of stretching prongs 1' and applying a certain amount of pressing force, without there being required any further connecting member. This assembly operation is made possible by a conical opening 7 which is provided at a lower receiving member 1*a* of the movable pair of stretching prongs 1', see FIGS. 5B, 6A and 6B. This receiving member 1*a* is made of an elastic plastic material which yields when a pressure is applied thereto.

The pair of stretching prongs 8' located at the other end of the stretching rod 2 is attached in the manner of conventional trouser hangers, i.e. rigidly and in a tight fit; in the illustrated exemplary embodiment the pair of stretching prongs 8' is supported at or integrally connected with an associated head member 19 which is appropriately secured to the related end of the stretching rod 2.

In the illustrated exemplary embodiment, the tight fittedly mounted pair of stretching prongs 8' as well as the movable pair of stretching prongs 1', the articulated bearing head member 6 and a connecting member 9 are manufactured from an unbreakable plastic material which is elastic to a certain extent like, for example, a suitable polyamide.

The stretching rod 2 is composed of two identical stretching rod members 2A and 2B which contactingly lie upon each other at their coacting and confronting planar surfaces or flat portions 10A and 10B and which are held together and guided by a tension spring 10, see FIGS. 4A and 4B. For reasons of assembly, the ends of the stretching rod members 2A and 2B are provided with tapered portions 10C and 10D at the locations which protrude from the tension spring 10. At their inwardly facing flat portions 10A and 10B, the stretching rod members 2A and 2B are provided with related grooves 11 in which the related ends of the tension spring 10 are received. Both ends of the tension spring 10 are identically shaped and comprise associated not particularly visible straight portions which are bent-off through the center region of the tension spring 10 so as to be positioned precisely in the grooves 11 of the related stretching rod members 2A and 2B. Each straight portion located at one of the ends of the tension spring 10 has the function of a spring eye and each of the grooves 11 at the related ends of the stretching rod members 2A and 2B have the function of a spring anchoring hook. When the two stretching rod members 2A and 2B are compressed or pushed towards each other in lengthwise direction, the tension spring 10 is thus tensioned by pulling at its ends in opposite directions.

The single, biased tension spring 10 is passed through the aforementioned connecting member 9 and is fully effective when the slightest compressing action is applied to the stretching rod members 2A and 2B. The tension spring 10 is preferably made of high-grade, non-slackening or fatigue-proof spring steel wire of round or circular cross-section.

For mounting a hook-shaped member 12, the connecting member 9 is provided at its base with an opening 13 through which the hook-shaped member 12 can be passed before the connecting member 9 is slid or pushed upon the tension spring 10. At its lower end, the hook-shaped member 12 is thickened or enlarged into the usual flat-head locking structure so as to provide limiting or locking means for positively connecting the hook-shaped member 12 with the stretching rod 2 to enable the hook-shaped member to accomplish its supporting or carrying function.

In order to improve the handling of the trouser hanger, that is to make the same more easily grippable for accomplishing the aforementioned compressing or pushing operation, the end faces 14 of the two pairs of stretching prongs 1' and 8' are advantageously of a concave design, i.e. are formed in an inwardly domed or trough-like manner.

In order to further safeguard against undesired trouser slide-off, the engagement edges 3, i.e. those edges which exert the actual tensioning or stretching effect at the creases of the trouser legs, are provided with small notches or serrations 15 along their total length. Additionally, the lower edge region of each engagement edge 3 is designed in a corrugated or undulated shape as indicated by reference numeral 16 in FIG. 5B. There are still further located in the aforementioned lower edge region a number of saw-tooth shaped noses 17, namely a larger wide nose and four smaller noses with upwardly directed edges, so that an assisting trouser carrying function results from the aforedescribed tooth-shape.

A further favorable aspect in the construction of the inventive trouser hanger is obtained with respect to the static stress on the stretching prongs as well as with respect to an improved appearance of the trouser hanger after mounting the trousers thereat, by providing sufficient clearances 18 at the two pairs of stretching prongs 1' and 8', see FIG. 3A. Due to such clearances 18, the pairs of stretching prongs 1' and 8' can be introduced to a greater depth into the trouser legs, so that the trouser legs are snugly arranged and flush with respect to the trouser hanger at the top thereof and nearly completely cover the same, which, in turn results in a better appearance of the entire assembly of stretched trousers and trouser hanger at which the same are held.

While there are shown and described present preferred embodiments of the invention, it is to be distinctly understood that the invention is not limited thereto, but may be otherwise variously embodied and practiced within the scope of the following claims. Accordingly,

What I claim is:

1. A trouser hanger stretchingly holding trousers at the trouser legs thereof, comprising:

a stretching rod;

a movable first holder containing a pair of stretching prongs and provided at said stretching rod;

said movable first holder being pivotably movable about a pivot axis extending substantially parallel to said pair of stretching prongs;

a rigid second holder containing a pair of stretching prongs and provided at said stretching rod;

said pairs of stretching prongs of said first holder and said second holder being insertable into the legs of the trousers;

a spring coacting with said first holder and said second holder;

said first holder and said second holder being displaceable relative to each other against the force of said spring;

each said movable first holder and said rigid second holder comprises a head member connectable to said stretching rod;

said pair of stretching prongs of said movable first holder being pivotably mounted at said head member of said movable first holder; and said pair of stretching prongs of said rigid second holder being mounted at said head member of said rigid second holder.

2. The trouser hanger as defined in claim 1, wherein:

said stretching rod comprises two opposite ends; and each one of said first holder and said second holder being mounted at a related one of said two opposite ends of said stretching rod.

3. The trouser hanger as defined in claim 1, further including:

trough-shaped gripping portions provided at each one of said first holder and said second holder.

4. The trouser hanger as defined in claim 1, further including:

two resiliently interconnected stretching rod members which constitute said stretching rod.

5. The trouser hanger defined in claim 4, wherein:

said spring comprises a tension spring interconnecting said stretching rod members;

each one of said stretching rod members being associated with a related one of said first holder and said second holder;

each one of said stretching rod members having a flat portion at least in the region remote from the related holder; and said flat portions of said stretching rod members being arranged within said tension spring in an overlapping manner such that said stretching rod members slide upon each other by means of said flat portions thereof.

6. The trouser hanger as defined in claim 5, further including:

a connecting member comprising a hook-shaped member; and said tension spring extending through said connecting member.

7. A trouser hanger stretchingly holding trousers at the trouser legs thereof, comprising:

a stretching rod;

a first holder movable about an axis and provided at said stretching rod;

a second rigid holder provided at said stretching rod;

said first holder and said second holder being insertable into the legs of the trousers;

a spring coacting with said first holder and said second holder;

said first holder and said second holder being displaceable relative to each other against the force of said spring;

each said first holder and said second holder comprising a head member connectable to said stretching rod;

said pair of stretching prongs of said movable first holder being mounted at said head member of said movable first holder; and said pair of stretching prongs of said rigid second holder being mounted at said head member of said rigid second holder;

said head member of said first holder constituting an articulated bearing head member; and a pivot pin pivotably interconnecting said articulated bearing head member and said pair of stretching prongs of said first holder.

8. The trouser hanger as defined in claim 7, wherein:

said pair of stretching prongs of said first holder contains a receiving member provided with a substantially conically shaped opening for receiving said pivot pin.

9. The trouser hanger as defined in claim 7, wherein:

said pair of stretching prongs of said second holder being rigidly mounted at the related head member.

10. The trouser hanger as defined in claim 9, further including:

engagement edges for engaging said legs of said trousers and being provided at each said stretching prong of said pair of stretching prongs of said second holder.

11. The trouser hanger as defined in claim 7, further including:

a predetermined number of engagement edges for engaging said legs of the said trousers and being provided at each stretching prong of said pairs of stretching prongs of said first holder and said second holder; and each one of said predetermined number of engagement edges being provided with notches.

12. The trouser hanger as defined in claim 11, wherein:

each said engagement edge comprises a lower edge portion; and said lower edge portion having an undulated structure.

13. The trouser hanger as defined in claim 11, wherein:

each said engagement edge is provided with a predetermined number of noses substantially structured in a saw-tooth shape.

14. A trouser hanger stretchingly holding trousers at the trouser legs thereof, comprising:

a stretching rod;

a first holder movable about an axis and provided at said stretching rod;

a second rigid holder provided at said stretching rod;

said first holder and said second holder being insertable into the legs of the trousers;

a spring coacting with said first holder and said second holder;

said first holder and said second holder being displaceable relative to each other against the force of said spring;

each said first holder and said second holder comprising a head member connectable to said stretching rod;

said pair of stretching prongs of said movable first holder being pivotably mounted at said head member of said movable first holder; and said pair of stretching prongs of said rigid second holder being mounted at said head member of said rigid second holder; and said pair of stretching prongs of said movable first holder being arranged at an offset from said pivot axis, about which said pair of stretching prongs is pivotable, in the direction of said rigid second holder.

15. The trouser hanger as defined in claim 14, further including:

engagement edges for engaging said legs of the trousers and being provided at each said stretching prong of said pair of stretching prongs of said first holder; and said engagement edges of each said stretching prong of said pair of stretching prongs of said first holder being offset from said pivot axis about which said pair of strecthing prongs is pivotable, by an amount substantially in the range of about 3 to about 4 millimeter in the direction of said second holder.

* * * * *